United States Patent [19]

Schweitzer

[11] Patent Number: 4,794,779

[45] Date of Patent: Jan. 3, 1989

[54] BENDING MACHINE

[76] Inventor: Leonard J. Schweitzer, 3272 Susileen Dr., Reno, Nev. 89509

[21] Appl. No.: 59,704

[22] Filed: Jun. 8, 1987

[51] Int. Cl.[4] ..... B21D 7/00

[52] U.S. Cl. ..... 72/389; 72/213; 72/308

[58] Field of Search ..... 72/212, 213, 384, 389, 72/457, 458, 479

[56] References Cited

U.S. PATENT DOCUMENTS

| | | | |
|---|---|---|---|
| 2,144,321 | 1/1939 | Bauberger et al. | 72/389 |
| 3,333,445 | 8/1967 | Mergler et al. | 72/389 |
| 3,568,493 | 3/1971 | Wirt et al. | 72/389 |
| 4,005,593 | 2/1977 | Goldberg | 72/389 |
| 4,304,117 | 12/1981 | Rawson | 72/457 |
| 4,594,875 | 6/1986 | Schweitzer | 72/389 |

FOREIGN PATENT DOCUMENTS

| | | | |
|---|---|---|---|
| 1955114 | 6/1970 | Fed. Rep. of Germany | 72/390 |
| 18772 | 6/1970 | Japan | 72/389 |

*Primary Examiner*—David Jones

*Attorney, Agent, or Firm*—Townsend & Townsend

[57] ABSTRACT

A hand operated rebar bender and bent rebar straightener which includes a base, a pair of spaced apart bending posts and a linearly reciprocal slide disposed between the posts and movable reciprocally in directions perpendicular to a line interconnecting the posts. The slide defines a first and a second groove, both adapted to receive rebar, which move with the slide. The first groove is positioned so that straight bar to be bent is originally tangent to the peripheries of the posts. The slide is movable over a distance sufficient to move the first groove past the line interconnecting the posts so that the appropriate bend is formed in the rebar. The second groove is positioned so that in one of the limiting positions of the slide travel it is relatively further removed in the direction of slide travel from the bending posts than the first groove to permit the insertion of bent rebar therein. The bent rebar is straightened by moving the slide, and therewith the second groove until the rebar in the second groove is substantially tangent to the peripheries of the bending posts, at which the point the previously bent rebar is straight.

17 Claims, 3 Drawing Sheets

BENDING MACHINE

BACKGROUND OF THE INVENTION

1. Field of the Invention

This invention relates to a hand operated device for bending metal bars, such as bars used to reinforce concrete, generally known as rebars, and in particular to such a device which is portable, can be used on the ground at construction sites and which is capable of bending and straightening rebar.

2. Description of Prior Art

U.S. Pat. No. 4,594,875, issued June 17, 1986 to the inventor hereof, discloses and claims an improved rebar bending machine which is lightweight, hand operated and adapted to be used in the field by a single person. It has a laterally stabilized, elongated base and, mounted to the base, a pair of spaced apart forming posts which straddle a slide mounted pair of lugs that form between them a groove into which rebar to be bent is placed. The slide is movable in an elongated guideway in a direction perpendicular to a line interconnecting the centers of the forming posts so that the groove defined by the lugs can be moved from a first position, at which a rebar placed in the groove is substantially tangent to the peripheries of the posts, past the line interconnecting the post centers, to a second position on the other side of the posts. In the course of this linear movement of the grooves a bend is formed in that portion of the rebar disposed between the lugs, Depending upon the length of travel of the lugs a bend of less than, equal to or greater than 90° is formed in the rebar although 90° bends are by far the most common.

That patent further discloses to generate the relatively large bending forces with an elongated handle that is pivotally attached to the base on the side of the posts which is opposite the side in which the rebar holding groove is substantially tangent to the post peripheries. Suitable linkage connected to the handle and the slide translates the pivotal handle movements into linear slide motions.

To minimize the weight of the bending machine, and to maximize the bending force, the slide, post and linkage are arranged so that the slide does not travel substantially more than the distance it must travel to effect the greatest bend in the bar, typically a bend of not more than about 120°. In this manner, the overall length of the device in general and of the slide, base and guideway in particular can be minimized, which saves weight, labor and costs. Within a given size and configuration of the machine, the bending force that can be generated with the manually operated handle can be maximized. An effective, high speed and accurate bending of the rebar is thus possible with the device of that patent.

Bending machines constructed in accordance with the above-mentioned patent have been on sale for more than a year and have met with exceptional success, It is believed that the success is to a large extent attributable to its compact size, relatively low weight and to its easy operation even on the uneven ground frequently encountered at construction sites.

At construction sites it is sometimes necessary to straighten previously bent rebar. This may be to undo a previously erroneously formed bend, to a need to reform a previously bent bar for use in a different application, or the like. Since the straightening of previously bent bar requires the same force as is required to form the original bend, a machine is necessary to accomplish it. The bending machine disclosed in the above discussed patent is not well suited to perform this task (unless the bend is only slight and substantially less than 90°) because a 90° bent rebar, for example, in the groove between the lugs cannot be simultaneously engaged with the forming posts so that the slide can be operated to straighten the bent section. To accomplish this the travel length of the slide-recounted lugs must be substantially increased. This, however, significantly increases the length of the device, and therewith its weight and cost, which is undesirable.

SUMMARY OF THE INVENTION

The present invention significantly improves the usefulness of the bending machine disclosed in the above discussed '875 patent by making it possible to both bend originally straight bar and straighten bent rebar. This is achieved with no or only a negligible increase in the overall length of the machine and its weight, and without significantly increasing its costs, Generally speaking the improved bending machine of the present invention differs from the bending machine disclosed in the referenced patent insofar as it provides the reciprocating slide with a second groove into which bent rebar to be straightened can be placed with, at the most, only a negligible increase in the overall travel length for the slide. The second groove is spaced from the first groove in the direction of slide travel (when bar placed in the first groove is being bent). The second groove is positioned so that bent rebar placed therein is approximately tangent to the peripheries of the forming posts on one side of the posts when straight rebar placed in the first groove is approximately tangent to the peripheries of the forming posts on the other side thereof.

As a result of this positional interrelationship between the first and second grooves the second groove is relatively remote from the forming posts when the slide has been moved the required distance to bend an originally straight bar placed in the first groove. Consequently, within these limits of slide travel a much greater distance is attained between the forming posts and the second groove than between the forming posts and the first groove. This significantly larger distance makes it possible to place a 90° bent rebar, for example, into simultaneous engagement with the peripheries of the posts and the second groove by locating the bent portion of the rebar in the second groove. The bent rebar can be straightened by moving the slide in the opposite direction until the second groove is substantially tangent to the periphery of the posts.

The second groove can be constructed in any one of several configurations. It is important, however, to position the second groove as close as possible to the first groove to avoid interference with the pivot support for the handle which activates the slide, or conversely, to avoid the need to increase the spacing between the forming posts and the handle pivot which would again increase the overall length of the device, its weight and cost, In its simplest form, the second groove can be defined by spaced apart, first and second lugs in substantially the same manner in which the first and second lugs of the first groove are constructed. In addition, the adjacent lugs for the two grooves can be combined into a single, double acting lug or post.

Bent rebar, when placed in the second groove, can pivot upwardly out of the groove, depending on the length of the bent rebar, the manner in which it is supported by the machine and/or the surrounding ground etc. The present invention also contemplates to constrain the bent rebar in the second groove against such upward movement. To accomplish this another embodiment of the invention defines the second groove partially with one of the lugs for the first groove and a hook, pivotally attached to the lug. The hook can be pivoted over the bent bar in the second groove so that a downwardly oriented free arm of the hook defines a portion of the second groove. Preferably, in this embodiment releasable lock means is provided to secure the hook in either its open or its closed position to prevent an accidental disengagement of the hook from the bar during the bar straightening operation.

DETAILED DESCRIPTION OF THE PREFERRED EMBODIMENT

Figure 1:
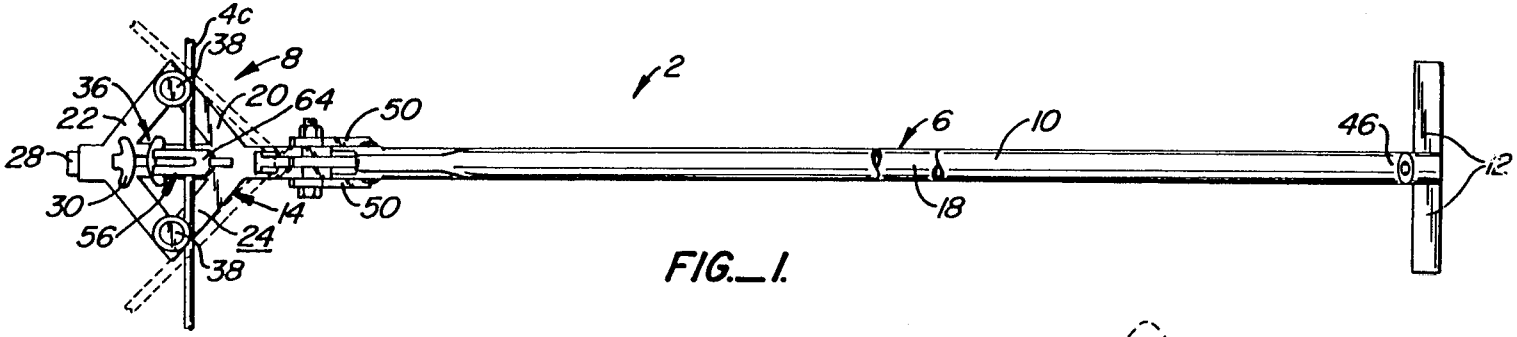
FIG. 1 is a plan view of the improved bending machine of the present invention and illustrates, in phantom lines, a bent rebar to be straightened and, in solid line, the previously bent bar in its straightened configuration.

Referring to FIGS. 1–4 a portable, hand-operated rebar bending machine 2 constructed in accordance with the present invention for bending straight or for straightening bent metal bar, typically round rebar 4, comprises an elongated base 6, a bending mechanism 8 at one end of the base and an actuating handle 10 operatively coupled with the bending mechanism. To provide stability for the machine the base includes generally transversely oriented cross-legs 12 at one end thereof and a transversely extending yoke 14 at the other end of the base and which forms part of the bending mechanism. To reduce the weight of the machine while maintaining rigidity the base and the cross-legs are preferably constructed from steel pipe.

Yoke 14 forms one end of the base and supports and houses the bending mechanism 8. It includes a tubular center section 16, which is secured, e.g. welded to or integrally constructed with the proximate end of an elongated steel pipe 18 which forms the major portion of the base, and a pair of angularly inclined arms 20, 22 which laterally protrude from the center section to either side thereof. The free ends of the arms are joined, e.g. welded together, for strength and rigidity. The upwardly facing surfaces of the center section 16 and arms 20, 22 are flat and lie in a common plane to define a flat, horizontal support surface for the rebar to be bent by the machine.

The tubular center section 16 of the yoke defines an internal, elongated, linear guideway 26 which linearly reciprocally mounts an elongated slide 28. The slide includes a pair of spaced apart lugs 30 which protrude from the slide through an elongated. upwardly open slot 32 in the tubular center section 16 of the yoke. The lugs have opposing, convexly arcuate bending surfaces 34 which define between them a first groove 36 of a sufficient width so that straight rebar to be bent can be placed in to the groove. The height of the lugs is greater than the diameter of the largest rebar capable of being bent by the machine, i.e. the height is greater than the width of groove 36.

A pair of bending posts 38 are positioned on a line perpendicular to the guideway 26 at the outward ends of arms 20, 22. Each post comprises a shaft 40 firmly secured, e.g. welded to the yoke and protruding upwardly past the flat support surface 24. A roller 42 is rotatably carried by the protruding portion of the shaft 40 and is suitably restrained to the shaft to prevent relative axial movements of the roller. Each roller has a height greater than the diameter of the largest rebar capable of being bent by the machine and a concave peripheral surface 44 for nesting the rebar during bending.

Handle 10 is preferably an elongated section of steel pipe having a free end 46 which is proximate cross legs 12 and a second end which is pivotal about a pivot shaft 48 carried on supports 50 protruding upwardly from the base. A lever 52 fixed, e.g. welded to the second end of the handle is angularly inclined relative to and extends from the handle past the pivot shaft towards guideway 26. A link 54 has its respective ends pivotally attached to the free end of the lever and the proximate end of slide 28. The link translates pivotal movements of handle 10 and the lever 52 into correspondingly reciprocating, linear movements of the slide 28 in guideway 26.

Figure 3:
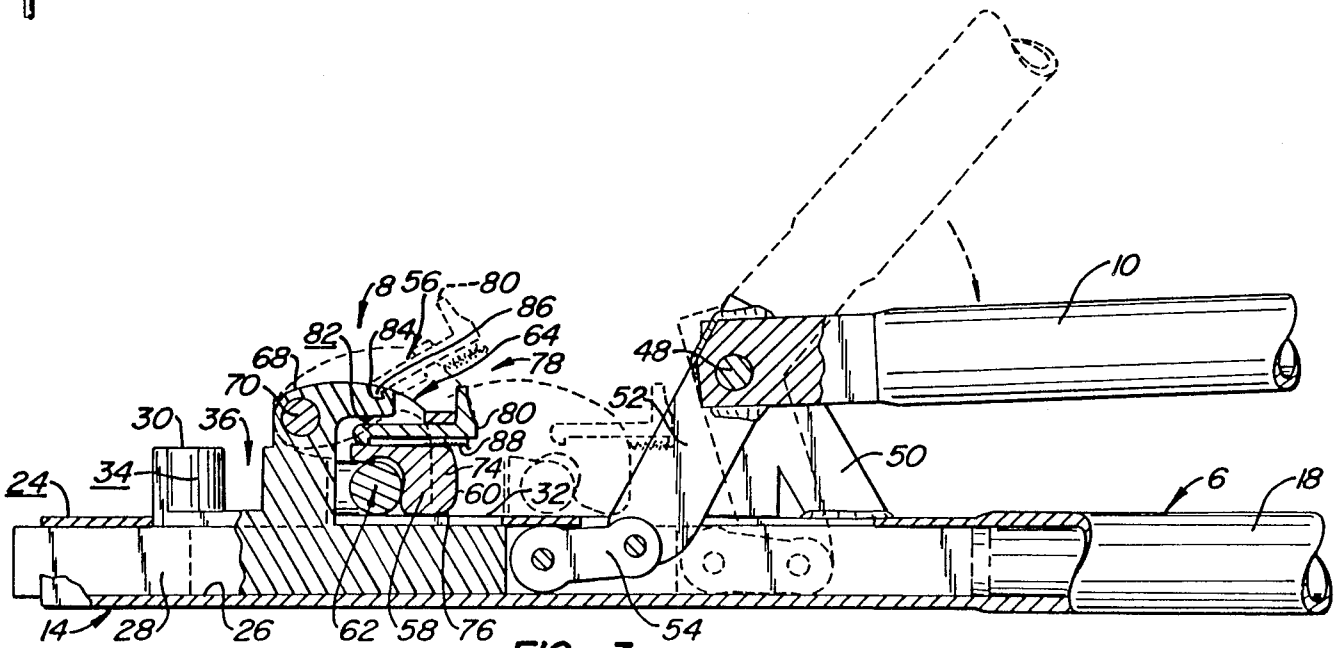
FIG. 3 is an enlarged, fragmentary plan view of a portion of the improved bending machine of the present invention shown in FIG. 1.

In use the lever is fully raised, or lowered, so that groove 36 between jaws 30 is disposed on one or the other side of a straight line connecting the peripheral surfaces 44 of bending post rollers 42. As shown in FIG. 3, for example, the lever may be initially fully lowered so that the groove is to the left of the bending posts. Next, rebar 4 is placed into the groove (see FIG. 1) and the operator raises handle 10 in a counterclockwise direction, as shown in FIG. 3, until it reaches the inclined position shown in phantom lines in FIG. 3. This pivotal movement of the lever causes a corresponding linear movement of the slide within guideway 26 and, thereby, moves jaws 30 from the left hand side of post 38 to the right hand side thereof (shown in phantom lines in FIG. 3). In the course of this movement, the left hand jaw (as seen in FIGS. 1–3) applies a bending force to the rebar and, upon engagement of the rebar by the concave peripheries of rollers 42, causes the formation of a bend in the rebar as is illustrated in FIG. 2.

The application of the bending force to the rebar causes a centering of the rebar with respect to the concave profile of bending post rollers 42 even if the rebar is originally skewed relative to the posts due to an unevenness of the ground at the construction site, for example. This facilitates the operator's task of maintaining the bend(s) and the bar in planar alignment, Moreover, the convexly shaped bending surface 34 of lugs 30 assure a smooth curvature in the bent rebar and prevent the formation of nicks in its surface which could adversely affect its strength.

Figure 2:
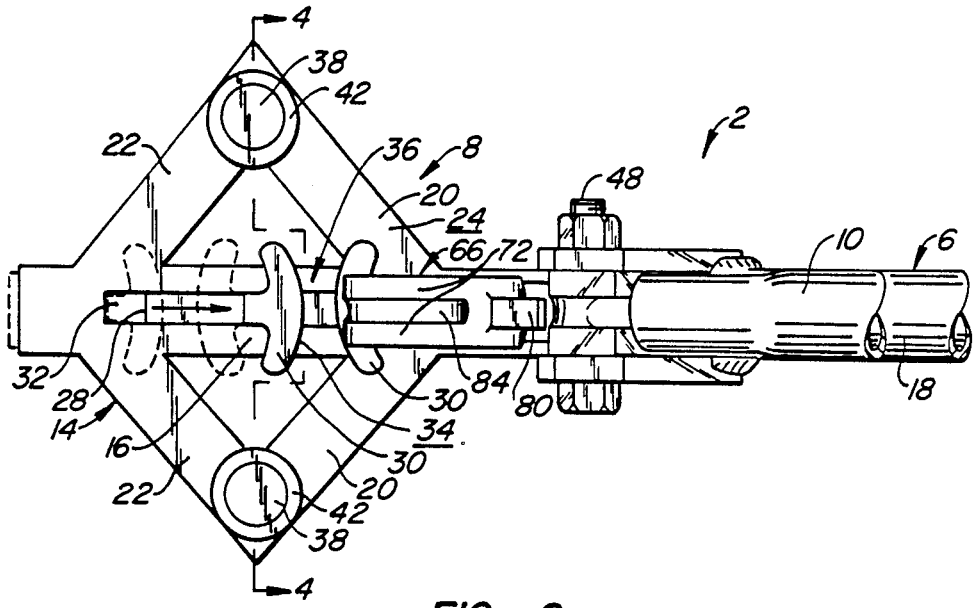
FIG. 2 is an enlarged, fragmentary plan view of the bending device of the present invention showing the bar inserted as in FIG. 1 which has been straightened by moving the operating handle from its raised position downwardly into its substantially horizontal position.
Figure 4:
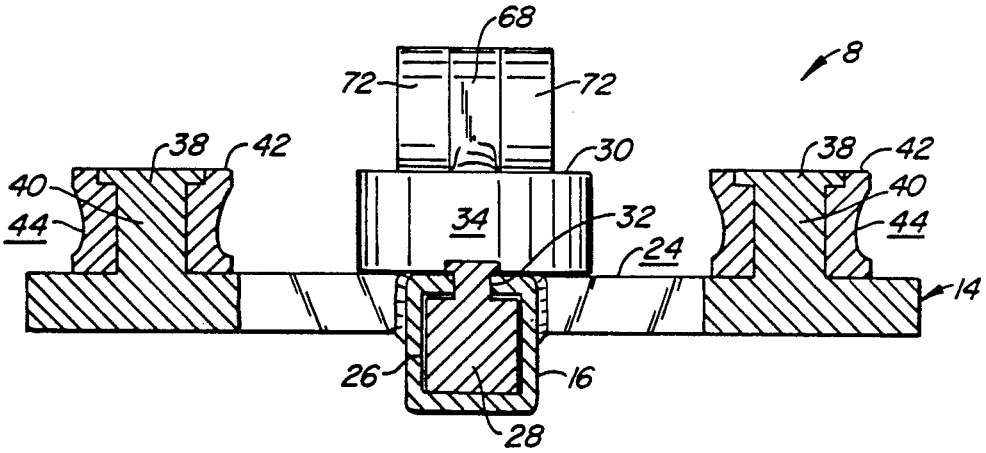
FIG. 4 is a front elevation in cross-section and is taking on line 4—4 of FIG. 2.

Rebar can also be bent by placing it into groove 36 when jaws 30 are to the right of the bending posts as seen in FIG. 2, for example, In such a case, the bending operation is performed by moving handle 10 in a clockwise direction as seen in FIG. 3, from its raised position (shown in phantom lines) to its lowered position.

The rebar bending device of the present invention is particularly adapted for use in the rough environment typically surrounding construction sites. It is relatively lightweight and is readily carried by one person. Cross-legs 12 and the laterally protruding arms 20, 22 of yoke 14 assure stability of the device even when placed on uneven ground. Tubular center section 16, which defines guideway 26, protects slide 26 from contact with abrasive ground, sand, etc. In addition, slide 28 is relatively long, e.g. five to ten times its width, to provide accurate guidance as it reciprocates within guideway 26 without causing wedging even when the forces applied by lugs 30 to the rebar tend to skew the slide.

Referring now to FIGS. 1–5, at bent rebar straightening assembly 56 is attached to slide 28 in the manner discussed in greater detail below. In a simplest embodiment of the invention the rebar straightening assembly comprises another pair of spaced apart lugs 58 which have opposing, convex surfaces 60 that define between them a second groove 62 of a sufficient width to accommodate the rebar to be bent. In the simplified embodiment of the invention illustrated in FIG. 5, an upright post 64 defines the respective convex surfaces of one lug each of lug pairs 30 and 58.

Lug pairs 30 and 58, and post 64 if it is used, are secured, e.g., welded to slide 28 so that they can be positioned as follows.

Figure 5:
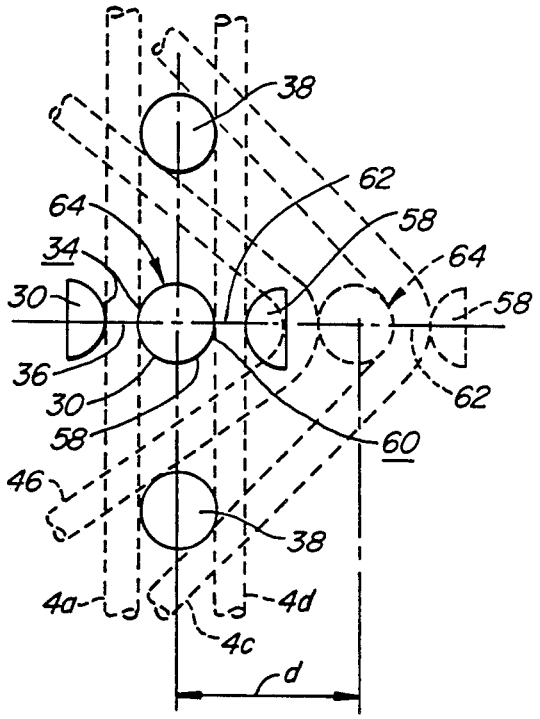
FIG. 5 is a schematic plan view which illustrates the manner in which the present invention is used to bend straight rebar and straighten bent rebar.

In a first position of the slide, lugs 30 are located so that rebar 4 placed into the first groove 36 is approximately tangent to the peripheries of bending post 38 as is illustrated in FIG. 5. The term "approximate" as used in connection with the relative positioning of the first groove is meant to indicate that the first groove can be positioned so that a rebar therein is tangent to the bending post peripheries. It further is meant to indicate that the slide can be moved beyond the tangential position, to one where the rebar in the first groove is spaced, typically by a small distance, from the bending post peripheries. This both facilitates the insertion of the rebar into the groove and obviates the need for precise tolerances in the relative positioning of a first groove and the forming post which for a rebar bender used in the rough environment typically prevailing at construction sites, is undesirable and difficult to maintain.

With the slide in the first position, as above defined, the second lug pair 58 (or post 64, if used) is positioned so that a straight rebar, if it were placed in second groove 62, would be approximately tangent to the peripheries of the bending posts but on the side of the bending posts opposite the side on which the first groove is located.

Further, slot 32 in tubular center section 16 has a length, and the handle pivot 48, the handle lever 52 and link 54 interconnecting the lever with slide 28 are arranged and constructed so that the slide can linearly move in guideway 26 from a first position in a first direction (to the right as illustrated in FIG. 5) to a second slide position over a distance "d" selected so that a straight rebar **4*a* placed into the first groove 36 is given the maximum possible bend that can be achieved with the bending machine, e.g. 90°, 120° or whatever other maximum bend may be desired. The second position of lug pairs 30 and 58, as well as of post 64 (which defines one lug of each pair) is illustrated in FIG. 5 in phantom lines. Also illustrated in phantom lines is the shape 4*b*** of the fully bent rebar, in the illustrated example it has a 90° bend.

In the second position of the slide the second groove 62 is spaced relatively far (in the first direction) from bending posts 38. The second lug pair 58 is positioned on the slide so that when the slide is in this second position at least 90° bent rebar **4*c* can be placed into the second groove (with the bent rebar section disposed in the groove) and so that the straight legs of the rebar are tangent to or clear of the peripheries of the bending posts. It is now a simple matter to straighten bent rebar 4*c* by operating handle 10, in the illustrated embodiment by pushing down on the handle to move the slide in a second, opposite direction from its second position to the above discussed first position. During this return movement of the slide bent rebar 4*c* is pushed against the peripheries of bending posts 38 and it is thereby straightened so that, when the slide is again in its first position, the previously bent rebar has taken on a straight configuration as is illustrated in FIG. 5 and identified by reference numeral 4*d***.

Referring now to FIGS. 1–4, in a further embodiment of the present invention rebar straightening assembly 56 is defined by a pivotally mounted hook 66 and a portion of one of lugs 30 as follows. Lug 30 has an upwardly projecting extension 68 which includes a transverse pivot shaft 70 that extends to either side of the extension. Hook 66 has bifurcated arms 72 which straddle the extension and pivotally engage the shaft 70 so that the hook can be pivoted between a first, open position (shown in phantom lines in FIG. 3) and a second, closed position (shown in FIG. 3 in solid lines).

The hook has a generally L-shaped configuration and includes a free leg 74 which, in the closed second position of the hook, is generally upright and has a free end 76 proximate the tubular center section 16 of the bending machine. When in the closed position the side of lug 30 facing in the first direction, together with free leg 74 of hook 66 define the second groove 62. It should be observed that the portion of the free leg 74 of the hook, as well as of bifurcated arms 72 close the second groove in an upward direction when the hook is in its closed position. Thus, rebar disposed in the second groove is constrained against relative upward movement out of the groove.

To prevent the unintentional opening of hook 66 it includes a lock 78, in the presently preferred embodiment defined by a generally L-shaped, flat bolt 80 which can be linearly reciprocated into and out of engagement with an underside 82 of an over hang 84 of extension 68. When bolt is moved to the left (as illustrated in FIG. 3) so that its upwardly directed surface engages underside 82, the hook is locked in its closed position and cannot unintentionally open. Conversely, when the bolt is moved to its right, as illustrated in FIG. 3, so that it clears the extension overhang 84, the hook can be pivoted in a counterclockwise direction (as seen in FIG. 3) into its open position. A slanted locking surface 86 on the upper side of overhang 84 is preferably provided to maintain the hook in its open position and to thereby facilitate the insertion of bent rebar to be straightened into the second groove, or the withdrawal of straightened rebar there from. Preferably, a spring 88 (schematically illustrated in FIG. 3) biases bolt 80 into its locking position, that is to the left as viewed in FIG. 3.

In this embodiment of the invention straight rebar is bent in the above-described manner. Bent rebar is straightened by moving slide 28 into its second position, that is as far to the right as possible (as seen in FIG. 3). hook 66 is opened, the bent section of the rebar is positioned beneath the hook, and the hook is thereafter closed and locked with bolt 80. Handle 10 is now pivoted in a clockwise direction, as viewed in FIG. 3, that is downwardly, to move the slide and with it the second groove and the bent rebar to the left, as seen in FIG. 3, towards bending posts 38. Free leg 74 of hook 66 thereby engages the bent section of the rebar and causes its straightening as it approaches a position at which the side of the rebar facing the bending posts becomes tangent to the peripheries of the bending posts. At that point further movement of the handle is discontinued, it is preferably reverse pivoted a short distance to disengage the straightened rebar from contact with the bending posts, bolt 80 is retracted and hook 66 is pivoted into its open position. The rebar is now withdrawn from the second groove by initially sliding it generally parallel to base 6 and tubular center section 16 until it clears the hook, and by thereafter withdrawing it upwardly.

What is claimed is:

1. Apparatus for bending a metal bar in a generally horizontal plane comprising a base;

first and second spaced apart forming posts projecting generally upwardly from the base; and a bar bending mechanism comprising a linearly reciprocating slide mounted to the base and movable relative thereto in a direction substantially perpendicular to a line interconnecting centers of the forming posts, the base including means defining a linear guideway for the slide, the mechanism including first and second, spaced apart bending means each adapted to engage a bar to be bent when the bar simultaneously contacts a periphery of each forming post so that movement of the mechanism deforms the bar, said first bending means comprising first and second, upwardly directed lugs attached to the slide and being spaced apart so as to form a first groove for accepting the bar for bending, said second bending means comprising means defining a second groove which is spaced from said first groove by a spacing, the second groove defining means being connected with the slide for linear movement therewith, and means for moving the mechanism, and thereby the first and second bending means over a predetermined distance selected so that the first bending means moves from a first position at which it is located, in the direction of movement, on one side of the forming posts to a second position at which it is located on another side of the forming posts, said spacing between the first and second bending means being selected so that during such movement the second bending means moves from a first location at which it is proximate a straight line interconnecting the peripheries of the forming posts on said another side thereof to a second location at said another side of the forming post at which it is remote from said forming posts, whereby bent bar can be straightened by placing it in the second bending means so that portions of the bent bar engage the peripheries of the forming posts and moving the second bending means from the second location to the first location thereof.

2. Apparatus according to claim 1 wherein the second groove defining means comprises a member attached to and projecting from the slide for movement therewith, the member defining a portion of the second groove, and hook means movably attached to the member and including a section defining another portion of the second groove which is spaced from the first portion thereof so as to accommodate the bar to be bent in the second groove.

3. Apparatus according to claim 2 including means for pivotally movably securing the hook means to the member.

4. Apparatus according to claim 3 wherein the hook means is pivotable between first and second position and is shaped so as to physically constrain the bar to be bent to the second groove when the hook means is in its first position and permit withdrawal of the bar to be bent from the second groove only when the hook means is in its second position.

5. Apparatus according to claim 4 including means for releasably locking the hook means in either its first or its second position.

6. Apparatus according to claim 5 wherein the locking means comprises a moveable bolt and cooperating locking surfaces defined by the member and the bolt and arranged so that the bolt can be operated to move the locking surfaces into and out of operative engagement when the hook means is in either its first position or its second position to thereby correspondingly lock and unlock the hooking means.

7. Apparatus according to claim 6 including means for biasing the bolt into the position in which the locking surfaces are in mutual engagement.

8. Apparatus for bending a metal bar comprising a base; guideway means at one end of the base defining an elongated, linear, substantially tubular guideway and including an upwardly open slot communicating with the guideway: first and second spaced apart vertical posts carried by the base; a slide located within the guideway and being reciprocal perpendicularly to a line connecting the posts; first and second upwardly directed lugs attached to the slide, projecting through the slot and forming a groove between them for accepting a metal bar for bending, the lugs being positioned and the slot having a length so that the groove can move with the slide perpendicular and relative to said line so that in a first position the groove is entirely on one side of the post and in a second position the groove is substantially on another side of the posts: and clamp means attached to the slide, projecting through the slot, being moveable with the slide and defining a second groove for accepting a metal bar for bending, the second groove being located on the slide so that when the first groove is in its first position, the second groove is on the other side of said line from the first groove; whereby the metal bar can be bent by placing it into the first groove and moving the slide to move the first groove from one side of the posts past said line towards said another side of the posts or by placing the metal bar in the second groove and moving the slide in the opposite direction from a position in which the second groove is relatively remote from another side of the posts to a position in which the second groove is proximate the another side of the periphery of the posts.

9. Apparatus according to claim 8 wherein the clamp means includes means constraining a metal bar placed in the second groove against relative upward movement out of the second groove.

10. Apparatus according to claim 9 wherein the clamp means comprises an upright member fixedly connected to the slide, and a generally L-shaped hook hingably attached to the member at a location spaced from the base and movable between a first position, in which the member and the hook define an upwardly closed second groove, and a second position in which the metal bar can be placed into and removed from the second groove by moving it generally parallel to the base.

11. Apparatus according to claim 8 wherein the clamp means comprises a member attached to and projecting upwardly from the slide for defining a second groove and for moving the member with the slide.

12. Apparatus according to claim 11 wherein the member is spaced from the second lug, is on the side thereof opposite from the first lug, and wherein the second groove is defined by the member and the second lug.

13. A hand operated device for the in-field bending of a metal bar in a generally horizontal plane comprising:

an elongated base having transverse stabilizers attached to first and second ends for preventing lateral tilting of the base when placed on the ground, the base defining a tubular, linear guideway adjacent the first end and an upwardly open, elongated slot communicating with the guideway:

an elongated slide linearly reciprocally disposed in the guideway having first and second lugs projecting through the slot and defining a first groove above the slot which is oriented substantially perpendicular to the guideway and which is shaped to receive the metal bar for bending, and a generally L-shaped hook including a free arm, the hook being hingably attached to the first lug at a point thereon spaced from the slide and being movable between a first position in which the free arm is substantially parallel to the lug and a free end of the arm is proximate the base so that the first lug and the hook define a second groove between them adapted to receive a metal bar for bending and a second position in which the free arm end is relatively remote from the base so that a metal bar can be moved into and out of the second groove by moving it generally parallel to the base, and means for releasably locking the hook in its first and second positions:

first and second forming posts mounted to the base, straddling the first and second lugs and being located relative to the slot so that the lugs can be positioned on either side of the posts by correspondingly moving the slide in the guideway:

an operating handle pivotally mounted to the base at a point above the base and including a lever having a free end and extending from a pivot axis of the handle toward the guideway in the base;

means operatively connected with the lever and the slide for translating pivotal handle motion into linear slide motion: the second groove being positioned relatively closer to the lever than the first groove; whereby a metal bar to be bent can be placed into the first groove and bent by moving the slide in a first direction towards the handle pivot axis or by placing the bar into the second groove and second opposite direction to moving the slide in a second, opposite direction to deform the bar by contacting it with one or the other side of the peripheries of the first and second posts.

14. Apparatus according to claim 13 including spring means biasing the locking means into the locked position.

15. Apparatus according to claim 13 wherein the first lug comprises a bending section attached to the slide defining a portion of the first groove, a generally upwardly oriented extension, a pivotal connection between the first lug and the hook located in the extension, and wherein the hook includes bifurcated arms projecting from the free arm of the hook straddling the extension of the first lug and forming part of the hinged connection.

16. Apparatus according to claim 15 wherein the locking means comprises a bolt constrained to the free arm of the hook movable between a first position in which it is proximate the extension of the first lug and a second position in which it is remote therefrom, the first lug extension including first and second locking surfaces which are angularly inclined with respect to each other and engagable by the bolt when it is in its first position and the hook is in either one of its first and second positions.

17. Apparatus for bending metal bar comprising a base adapted to be placed on the ground defining a tubular, linear guideway and including first and second, stationary posts projecting upwardly from the base, straddling the guideway and being located on a line substantially perpendicular to the guideway: a slide disposed in the guideway and being linearly movable therein between first and second positions: first bending means carried by the slide defining a first bending groove adapted to receive a bar to be bent and positioned on the slide so that the bar in the first groove is approximately tangent to a line interconnecting peripheries of the posts on one side of the posts when the slide is in its first position so that, when the slide is moved in a first direction from the first position towards a second position, the first groove moves past the line interconnecting centers of the posts and thereby causes a bending of the metal bar; second bending means carried by the slide defining second groove adapted to receive a metal bar including a previously formed bent section intermediate its ends and located on the slide so that straight positions of the bar intermediate the bent section and the ends of the bar when the bar is in the second groove as approximately tangent to the peripheries of the posts on another side of the posts when the slide is proximate its second position, whereby the bar including the bent section can be straightened by positioning the slide proximate its second position, placing the bent section of the bar in the second groove, and moving the slide in a second direction towards its first position so that such movement causes straightening of the bent section as the slide approaches the first position.

* * * * *